US005908331A

United States Patent [19]

Hsu et al.

[11] Patent Number: 5,908,331

[45] Date of Patent: Jun. 1, 1999

[54] MINIATURE DIN CONNECTOR

[75] Inventors: Sung-Liu Hsu, Taipei Hsien; Chun-Chu Wang, Pan-Chiao, both of Taiwan

[73] Assignee: Hon Hai Precision Ind. Co., Ltd., Taipei Hsien, Taiwan

[21] Appl. No.: 08/916,274

[22] Filed: Aug. 22, 1997

[30] Foreign Application Priority Data

Sep. 23, 1996 [TW] Taiwan ..... 85214790

[51] Int. Cl.[6] ..... H01R 13/648

[52] U.S. Cl. ..... 439/607

[58] Field of Search ..... 439/92, 95, 607, 439/609, 939

[56] References Cited

U.S. PATENT DOCUMENTS 5,378,172 1/1995 Roberts ..... 439/607
5,622,523 4/1997 Kan et al. ..... 439/939 X
5,733,146 3/1998 Block ..... 439/610

*Primary Examiner*—Khiem Nguyen

[57] ABSTRACT

A short-body miniature DIN connector consists of a dielectric body defining an inverted T-shaped locking slot, a horizontal and vertical ridge on a right and left face. A number of contacts each has a first fitting portion having an interference fit with the body defining a corresponding contact passage extending through the body, and a second fitting portion having an interference fit with the body defining a corresponding locating groove located at a bottom of a rear face of the body. A shielding shell covers the body and has an upper wall defining an inverted-T shaped locking tab bent into the locking slot to have an interference fit with the body and two flaps extending downwards from two sides thereof. The shielding shell further has a right and left wall each defining a vertical and horizontal projection engaging the horizontal and vertical ridges, and an upper fin engaging with a corresponding flap, whereby a rebound of the right and left walls to move away from the dielectric body can be prevented.

16 Claims, 8 Drawing Sheets

MINIATURE DIN CONNECTOR

BACKGROUND OF THE INVENTION

1. Field of the Invention

The invention relates to a miniature DIN connector, particularly to a miniature DIN connector of a short body type which has a thickness of 8.0 mm, while a long body type has a thickness of 12.8 mm.

2. The Prior Art

Miniature DIN connectors have been used as a connector for connecting a periphery device to a computer, for example an external keyboard to a laptop computer. The following documents relate to some prior art miniature DIN connectors: Taiwan Patent Application Nos. 77208107, 78204790, 80104898, 80208342, 80211820, 82111200, 82201874, and 84201441 and U.S. Pat. Nos. 4,637,669, 4,842,554, 4,842,555, 4,908,335, 4,995,819, 5,017,158 and 5,186,633.

To save the space that the miniature DIN connectors would occupy, short-body miniature DIN connectors have been developed which have a thickness of 8 mm to replace long-body miniature DIN connectors which have a thickness of 12.8 mm.

However, the conventional short-body miniature DIN connectors are found to have the disadvantages as set forth below.

Firstly, since each of the short-body miniature DIN connectors has a dielectric body with a short thickness, the area available for connecting the dielectric body with an electromagnetic shielding shell is greatly limited. This brings about that to securely connect the dielectric body and the shielding shell needs a very complicated assembling operation.

Secondly, the contacts thereof each has a complicated structure, which brings about that to manufacture the contacts and to assemble the contacts with the dielectric body are difficult and troublesome.

Therefore, an objective of the invention is to provide a short-body miniature DIN connector with a shielding shell and a dielectric body which can be easily and securely connected with each other by a simple assembling operation.

Another objective of the invention is to provide a short-body miniature DIN connector with contacts which have a simple structure so that they can be easily formed; furthermore, the contacts can be easily and securely mounted to the dielectric body.

SUMMARY OF THE INVENTION

According to an aspect of the invention, a short-body miniature DIN connector includes a dielectric body having a circular plug portion defining a number of contact passages, an inverted T-shaped locking slot located at a corner between a top face and a rear face of the body, horizontal and vertical ridges formed on a left and right side face of the body, and a number of partitioning blocks located along a bottom of the rear face of the body to define a number of locating grooves. A number of contacts each has a contact portion and a first fitting portion extending into a corresponding contact passage, wherein the first fitting portion has an interference fit with the body defining the corresponding contact passage, a leg portion extending downwards from the corresponding contact passage and perpendicular to the contact and first fitting portions, a second fitting portion extending through a corresponding locating groove to have an interference fit with the body defining the corresponding locating groove, and a terminal portion extending below a bottom face of the body for connecting with a printed circuit board. A shielding shell covers the front, top, right and left side faces of the body. The shielding shell has an upper wall defining an inverted T-shaped locking tab protruding from a rear edge thereof. The locking tab is bent to enter the inverted T-shaped locking slot and defines two toothed sides having an interference fit with the body defining the locking slot. Furthermore, the shielding shell has a right and left wall defining horizontal projections engaging the horizontal ridges and vertical projections engaging the vertical ridges on the left and right side faces of the body. Moreover, the upper wall of the shielding shell defines two flaps extending downwards from two lateral sides of the upper wall and engaging with two fins defined at an upper side of each of the right and left walls of the shielding shell to prevent a rebound of the right and left walls to move away from the dielectric body.

BRIEF DESCRIPTION OF THE DRAWINGS

FIG. 4 (B) is a view similar to FIG. 4 (A), but shows a second contact;

DETAILED DESCRIPTION OF THE PREFERRED EMBODIMENT

References will now be described in detail to the preferred embodiment of the invention. While the present invention has been described in reference to the specific embodiment, the description is illustrative of the invention and is not to be construed as limiting the invention. Various modifications to the present invention can be made to the preferred embodiment by those skilled in the art without departing from the true spirit and scope of the invention as defined by appended claims.

Figure 1:
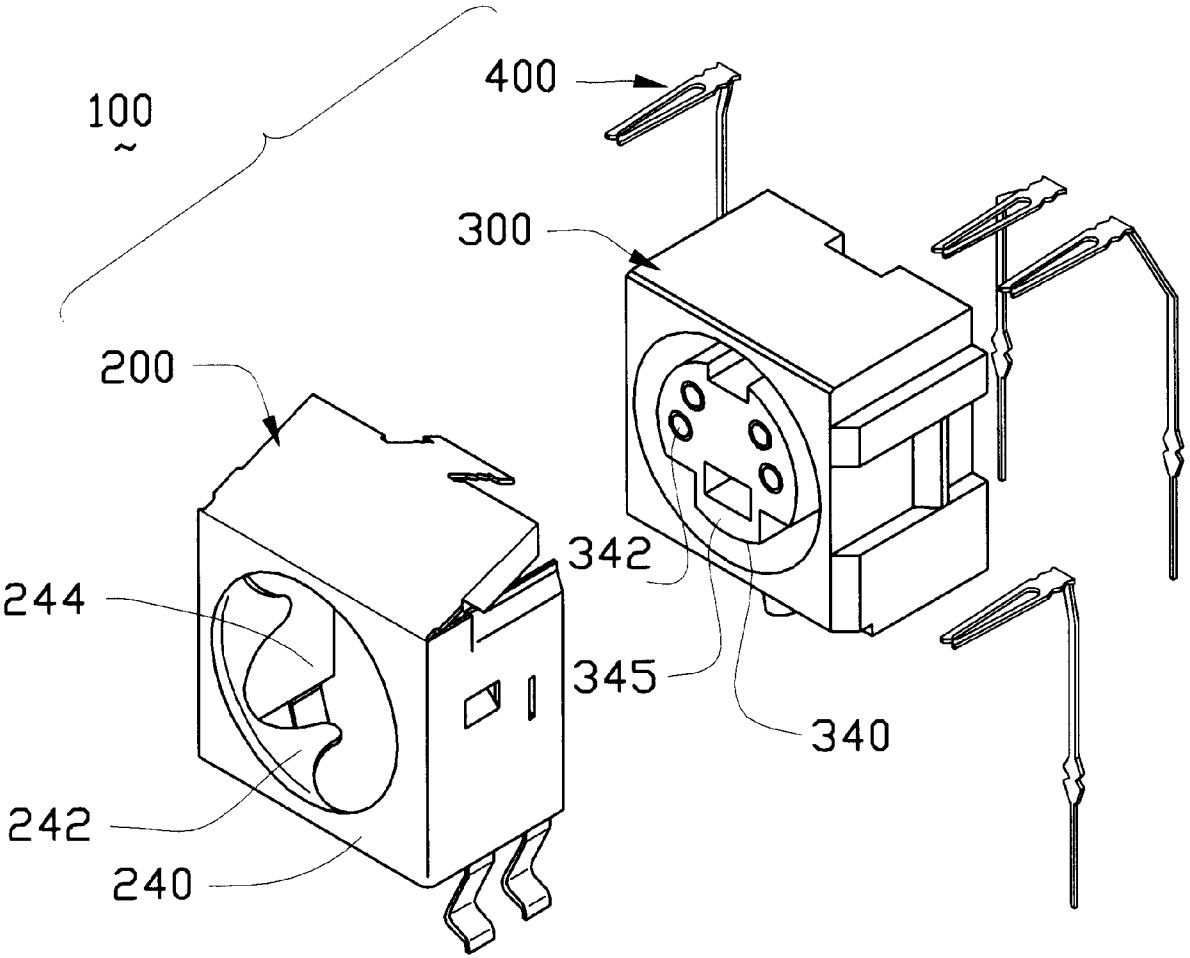
FIG. 1 is a perspective, exploded view showing elements for constituting a short-body miniature DIN connector in accordance with the present invention.

FIG. 1 shows a 4-pin, short-body miniature DIN connector 100 in accordance with the present invention. The connector 100 is used for connecting, for example, a keyboard to a laptop computer. The connector generally consists of a shielding shell 200 made of a steel plate, a dielectric body 300 and four conductive contacts 400.

Figure 2:
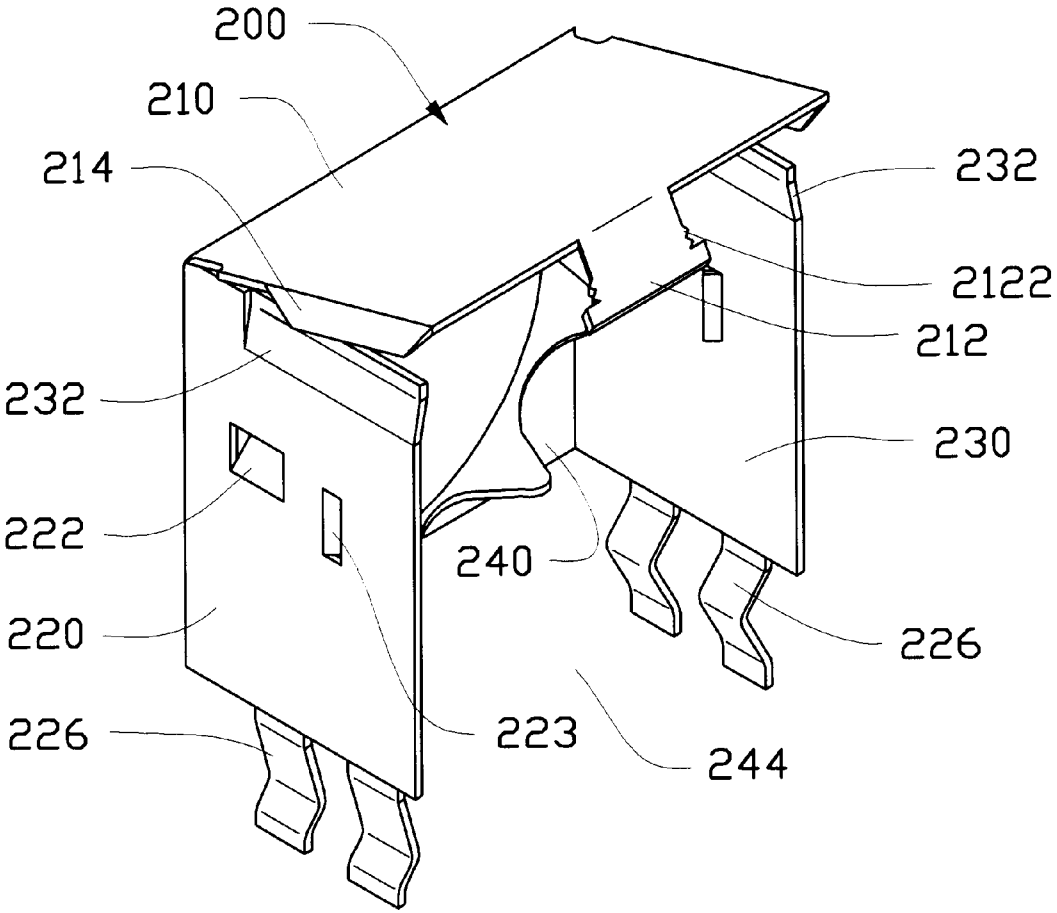
FIG. 2 is a perspective view showing a shielding shell of the connector in accordance with the present invention.

Also referring to FIG. 2, the shielding shell 200 is constructed like a rectangular hollow box having an upper wall 210, a right wall 220, a left wall 230 and a front wall 240. The shielding shell 200 has an open rear and lower side and defines an inner space 244 for receiving the body 300. The front wall 240 defines a circular opening 242, whereby a mating portion of a mating connector (not shown) can be inserted into the connector 100 to connect therewith. The upper wall 210 defines an inverted T-shaped locking tab 212 protruding from a rear edge thereof. The locking tab 212 defines two toothed portions 2122 about its two lateral sides. The upper wall 210 further defines two flaps 214 extending downwards from a rear portion of its two lateral sides. Each of the right and left walls 220, 230 defines a fin 232 about a rear portion of an upper edge thereof, a horizontal projection 222 and a vertical projection 223 located below the fin 232, wherein the vertical projection 223 is located nearer to the rear side of the shielding shell 200 than the horizontal projection 222, and a pair of grounding tabs 226 extending downwards from a bottom edge thereof. The grounding tabs 226 are used to be soldered to a printed circuit board (not shown) to fixedly mount the connector 100 to the printed circuit board and connect the shielding shell 200 to ground. All of the fins 232 and horizontal and vertical projections 222 and 223 are formed to have a free end extending toward the inner space 244.

Figure 3:
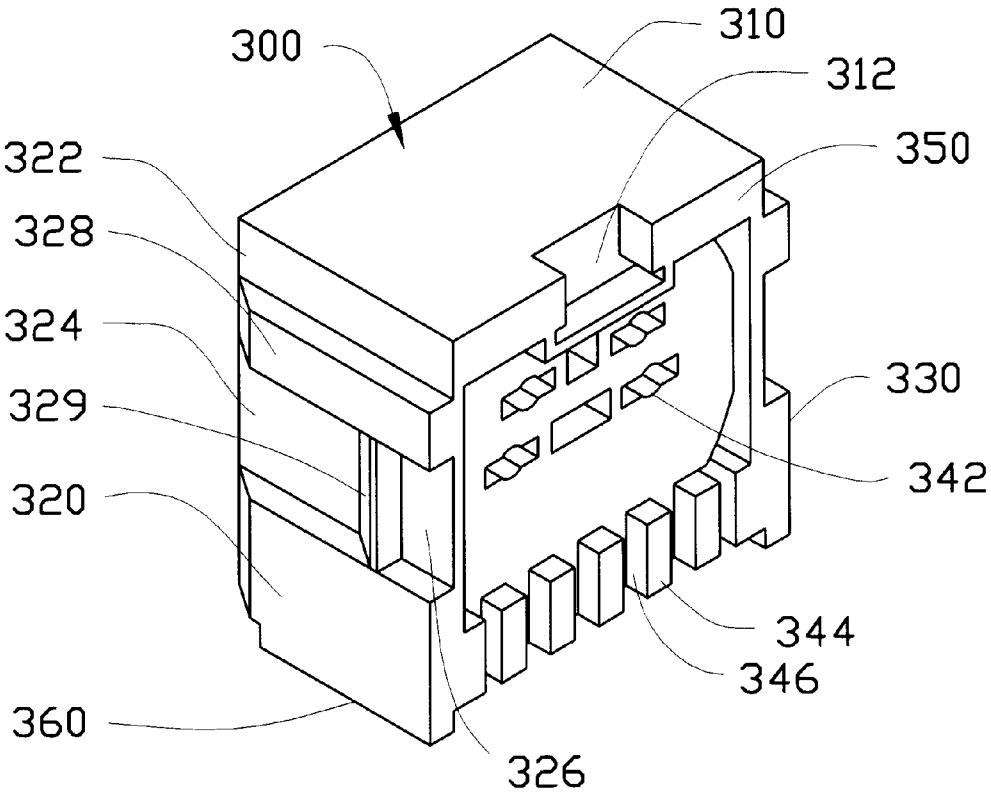
FIG. 3 is a perspective view showing a dielectric body of the connector in accordance with the present invention.

Also referring to FIG. 3, the dielectric body 300 is configured like a rectangular block defining a central circular plug portion 340. The plug portion 340 defines four contact passages 342 extending therethrough. The four contact passages 342 are used for receiving the four contacts 400. Furthermore, the body 300 is formed to have a top face 310, a right side face 320, a left side face 330, a rear face 350 and a bottom face 360. A locating post 362 (FIG. 5) is extended downwards from the bottom face 360. The locating post 362 is used to fit with a locating hole in the printed circuit board (not shown), when the connector 100 is mounted thereto. A locking slot 312 is formed at a corner between the upper face 310 and the rear face 350. The locking slot 312 has an inverted T-like shape as viewed from a rear side of the body 300. Each of the right side face 320 and the left side face 330 defines an upper recess 322, a front and rear recess 324 and 326 both located below the upper recess 322. A horizontal ridge 328 is formed between the upper recess 322 and the front and rear recesses 324, 326. A vertical ridge 329 is formed between the front and rear recesses 324, 326. Five partitioning blocks 344 are integrally formed along a lower portion of the rear face 350 to define six locating grooves 346 equidistantly spaced with each other.

Figure 4A:
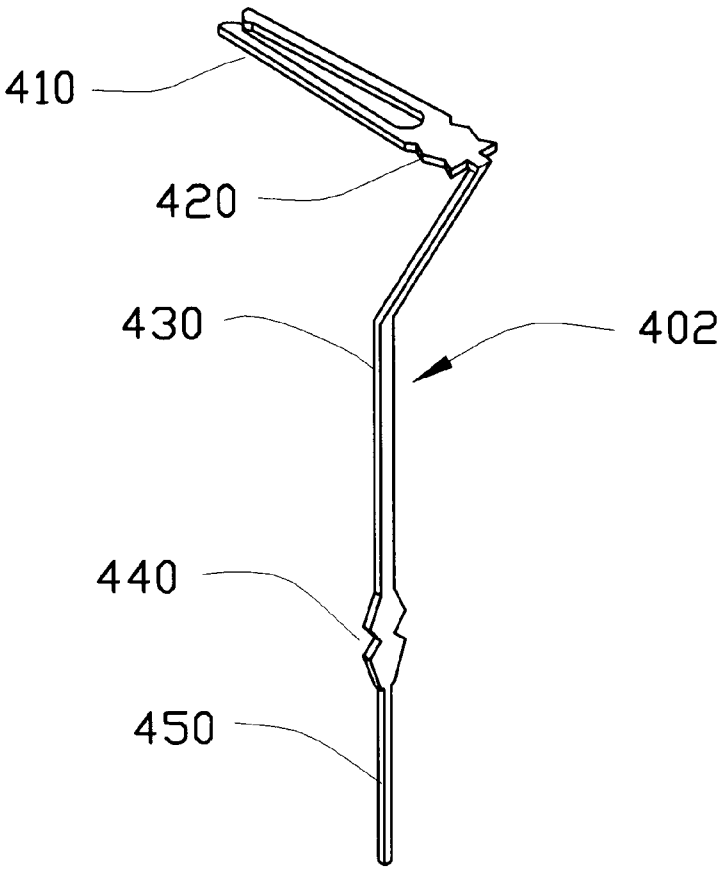
FIG. 4 (A) is a perspective view showing a first contact of the connector in accordance with the present invention.
Figure 4B:
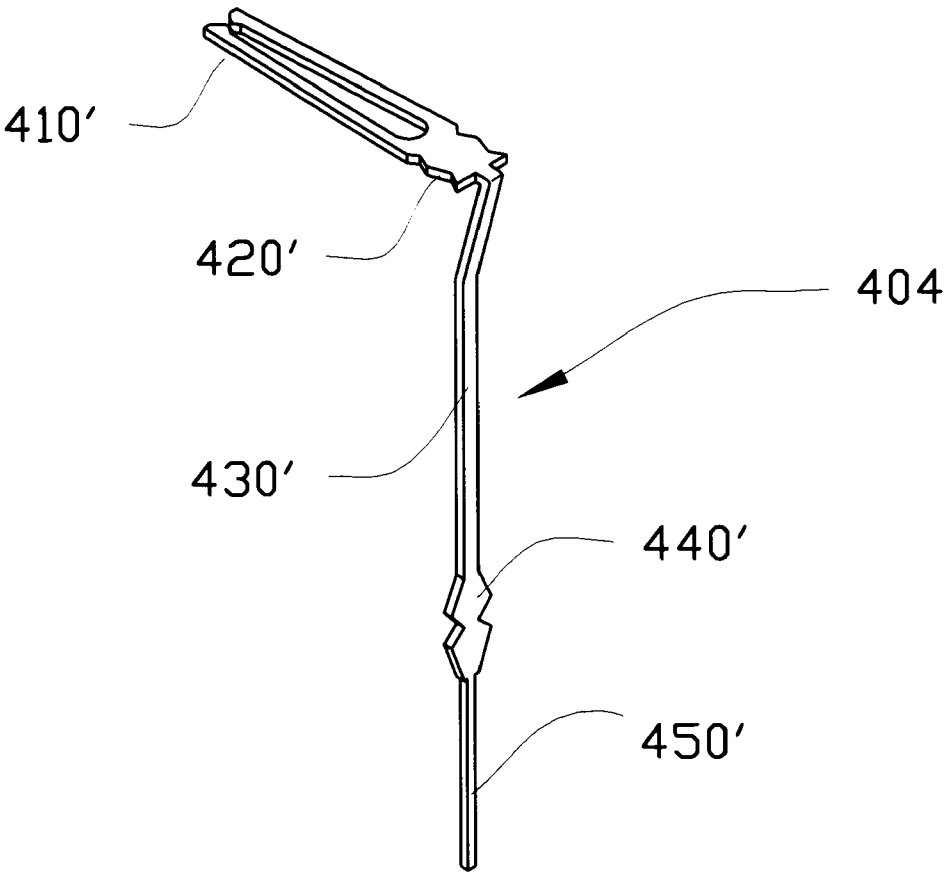

Also referring to FIGS. 4 (A) to 5, the four contacts 400 can be divided into two groups: a pair of longer contacts 402 and a pair of shorter contacts 404. Each of the longer contacts 402 is formed to have a contact portion 410 having a form like a fork for engaging with a mating contact of a mating connector (not shown) in connection therewith. A first fitting portion 420 in the form of several barbs protruding sidewards is defined in rear of the contact portion 410 and in flush therewith. The first engaging portion 420 is used to have an interference fit with the body 300 defining a corresponding contact passage 342 to fix the contact 402 to the body 300. A leg portion 430 extends downwards from the first fitting portion 420 and is substantially perpendicular thereto. A second fitting portion 440 in the form like the first fitting portion 420 is defined below the leg portion 430. And a terminal portion 450 is defined below the second fitting portion 440. The terminal portion 450 is used to be electrically and mechanically connected to the printed circuit board (not shown).

Each of the shorter contacts 404 has a construction similar to that of the longer contacts 402. The shorter contact 404 also includes a contact portion 410', a first fitting portion 420', a leg portion 430', a second fitting portion 440' and a terminal portion 450'. However, the leg portion 430' has a length which is much shorter than that of the leg portion 430.

Figure 5:
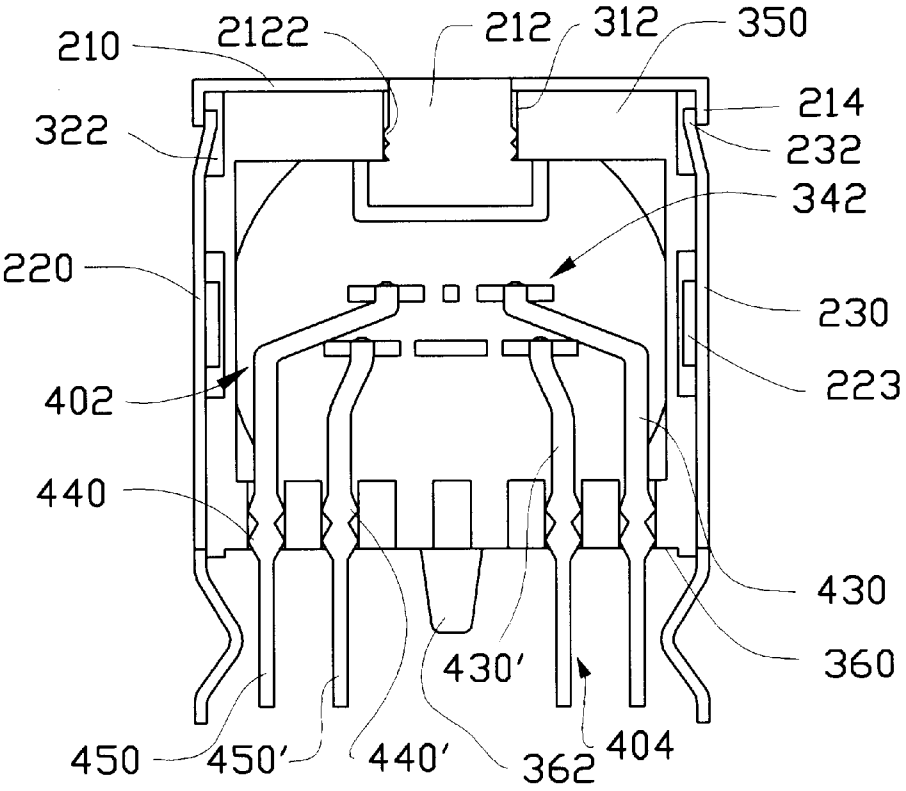
FIG. 5 is a rear view showing that the elements constituting the connector in accordance with the present invention are assembled.
Figure 6:
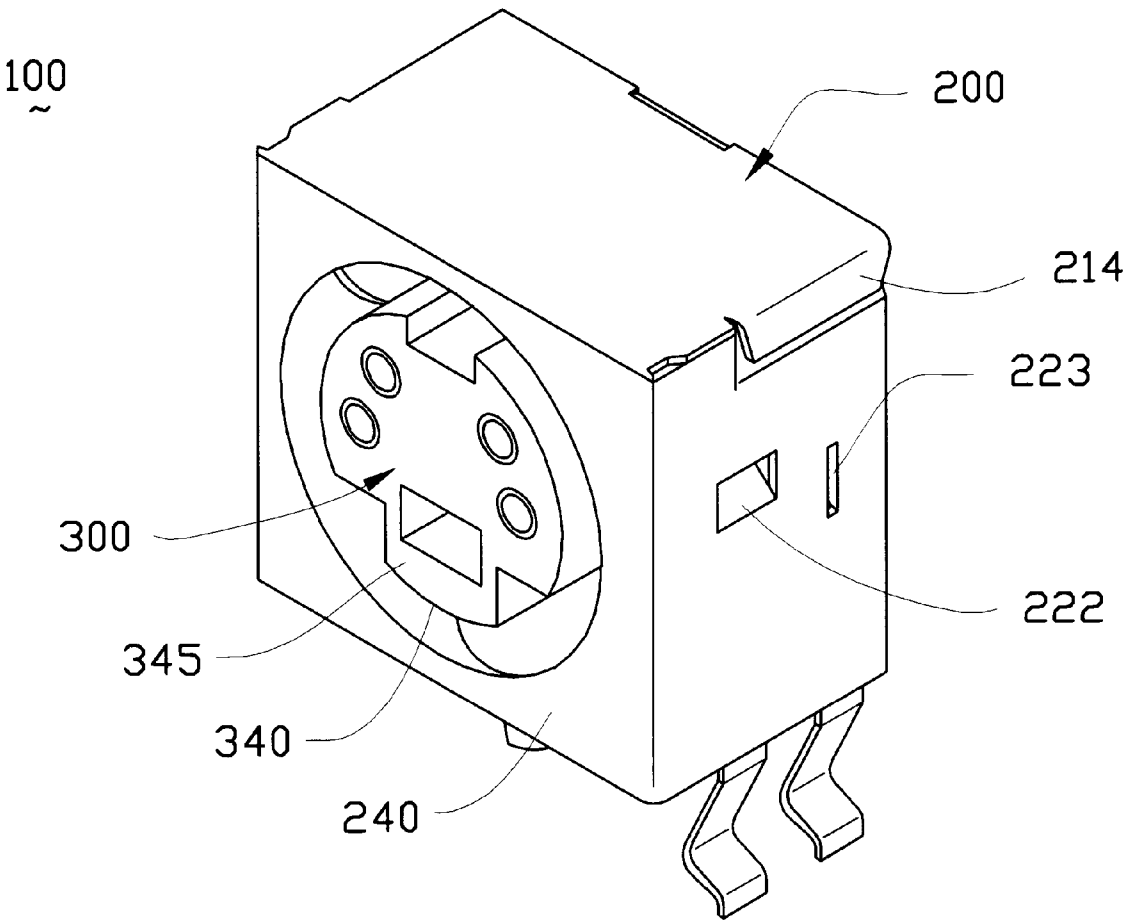
FIG. 6 is a front-right-top perspective view of the connector of FIG. 5.
Figure 7:
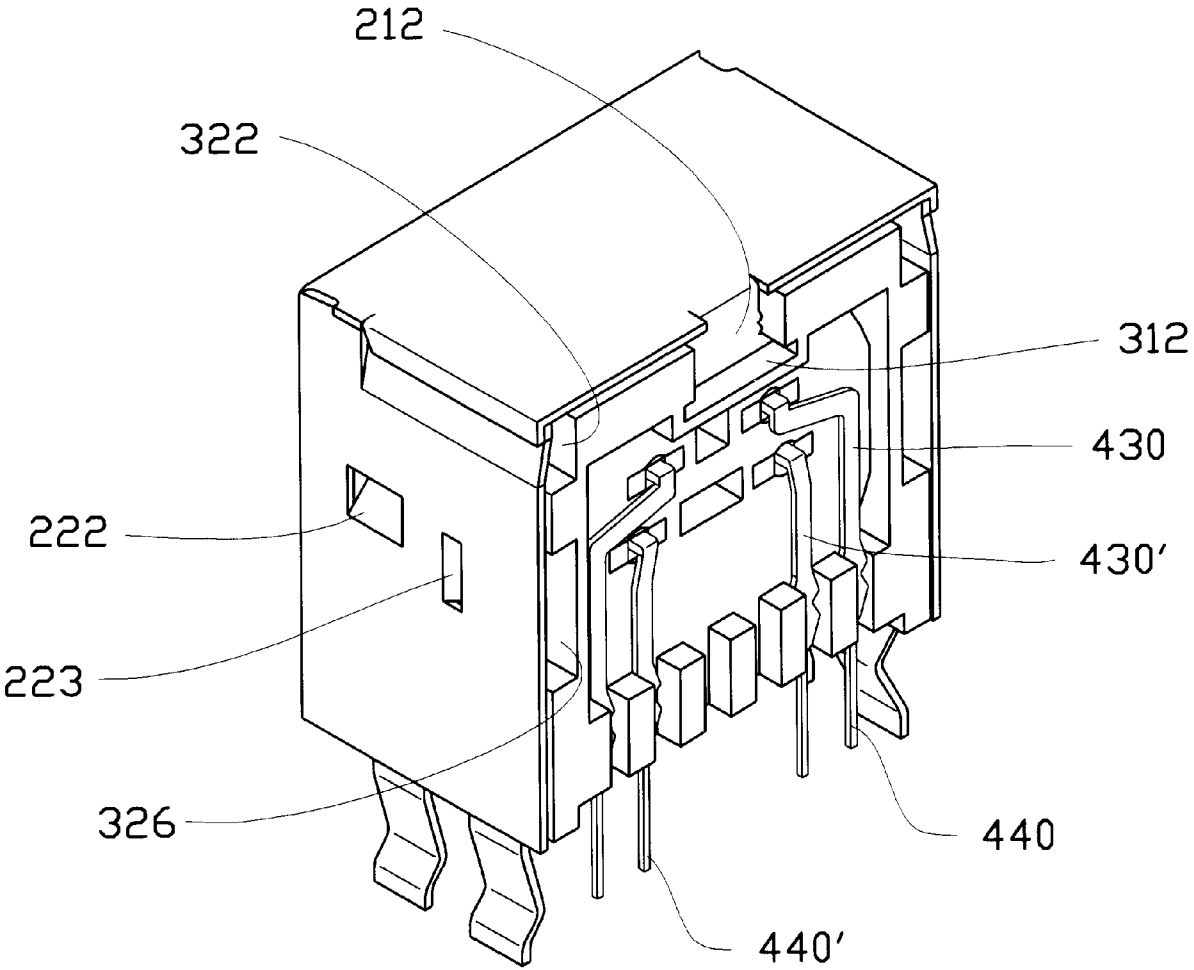
FIG. 7 is a rear-right-top perspective view of the connector of FIG. 5.

Also referring to FIGS. 6 and 7, to assemble the above mentioned constituting elements of the connector 100 in accordance with the present invention, firstly, the contacts 400 are brought to be mounted to the body 300 by extending the contact portions 410, 410' and the first fitting portions 420, 420' into the contact passages 342, wherein the first fitting portions 420, 420' have an interference fit with the body 300. The leg portions 430, 430' are extended downwards from the contact passages 342 to reach a position wherein the second fitting portions 440, 440' are extended through the locating grooves 346 to have an interference fit with the body 300 and the terminal portions 450, 450' are located below the bottom face 360. In the present invention, as shown by FIG. 5, the contacts 404, which have shorter leg portions, are located between the contacts 402, which have longer leg portions.

After the body 300 is mounted with the contacts 400, the body 300 is assembled with the shielding shell 200 by bringing the body 300 into the inner space 244 to reach a position wherein a front face 345 of the circular plug portion 340 is in flush with a front face of the front wall 240 and located coaxially in the circular opening 242. Then, the right and left walls 220 and 230 are bent toward the right and left side faces 320, 330 of the body 300 to cause the horizontal projections 222 to engage with the horizontal ridges 328 and the vertical projections 223 to engage with the vertical ridges 329. Meanwhile, the upper wall 200 is bent downwards toward the top face 310 of the body 300 and the locking tab 212 is bent to enter the inverted T-shaped locking slot 312 to cause the toothed portions 2122 to have an interference fit with the body 300 defining the locking slot 312, whereby the body 300 and the shielding shell 200 are securely connected. As shown in FIG. 5, when the body 300 and the shielding shell 200 are connected, the two flaps 214 are engaged with the fins 232 to prevent a rebound of the right and left walls 220, 230 to move away from the body 300. The two fins 232 are bent to extend into the upper recesses 322.

Although in the preferred embodiment, the terminal portions 450, 450' are constructed to be in line with the leg portions 430, 430', it is known by those skilled in the art that they can be bent to be perpendicular to the leg portions so that they can be connected to the printed circuit board by SMT (surface mounting technology).

From the above disclosures, it can be understood that the dielectric body 300 and shielding shell 200 of the present invention can be securely connected by simply first bending the right and left walls 220, 230 and then the top wall 210 of the shielding shell 200 toward the dielectric body 300 and thereafter inserting the inverted T-shaped locking tab 212 into the inverted T-shaped locking slot 312 to cause the toothed portions 2122 to have an interference fit with the dielectric body 300.

Furthermore, the contacts 400 of the present invention have a relatively simple structure and can be securely mounted to the dielectric body 300 by a simple operation.

Thus, in comparison with prior art, the present invention has the advantages of simple structure and easy assembling operation.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, person of ordinary skill in this field shall understand that all such equivalent structures are to be included within the scope of the following claims.

We claim:

1. A short-body miniature DIN connector, comprising:

a dielectric body having a front face for connecting with a mating connector, a rear face opposite to the front face, a bottom face for connecting with a printed circuit board, a top face opposite to the bottom face, and a locking slot located at a corner between the top face and the rear face of the body;

a number of contacts mounted to the body;

a shielding shell covering the dielectric body and having an upper wall and two side walls, said upper wall defining a locking tab bent to enter the locking slot to have an interference fit with the body defining the locking slot and two flaps extending downwards from two lateral sides of the upper wall to engage with upper edges of the two side walls to prevent the two side walls from moving away from the dielectric body.

2. The connector in accordance with claim 1, wherein the locking slot has an inverted T-like shape as viewed from a rear side of the body.

3. The connector in accordance with claim 2, wherein the locking tab has an inverted T-like shape protruding from a rear edge of the upper wall of the shielding shell.

4. The connector in accordance with claim 1, wherein the body has a circular plug portion defining a number of contact passages extending therethrough, and each of the contacts has a first part extending into a corresponding contact passage and a second part extending along the rear face of the body.

5. The connector in accordance with claim 4, wherein the body further defines a number of locating grooves on the rear face, and each of the second parts of the contacts has a first fitting portion extending through a corresponding locating groove to have an interference fit with the body.

6. The connector in accordance with claim 5, wherein the locating grooves are formed at a lower portion of the rear face of the body.

7. The connector in accordance with claim 1, wherein the body comprises a right and left side face each defining a horizontal ridge and a vertical ridge, and the two side walls of the shielding shell each defines a horizontal projection engaging a corresponding horizontal ridge and a vertical projection engaging a corresponding vertical ridge.

8. The connector in accordance with claim 1, wherein the body comprises a right and left side face each defining an upper recess and wherein the upper edges of the two side walls of the shielding shell, which are engaged with the flaps, are bent to enter into the upper recesses.

9. The connector in accordance with claim 5, wherein each of the second parts of the contacts has a terminal portion for connecting with a printed circuit board, said terminal portion being in line with the first fitting portion.

10. The connector in accordance with claim 5, wherein each of the second parts of the contacts has a terminal portion for connecting with a printed circuit board, said terminal portion being perpendicular to the first fitting portion.

11. The connector in accordance with claim 4, wherein each of the first parts of the contacts has a second fitting portion having an interference fit with the body defining the corresponding contact passage.

12. The connector in accordance with claim 5, wherein each of the first parts of the contacts has a second fitting portion having an interference fit with the body defining the corresponding contact passage.

13. A method for forming a short-body miniature DIN connector, comprising the following steps:

preparing a dielectric body to have circular plug portion defining a number of contact passages extending from a front face for connecting with a mating connector to a rear face of the body, an inverted T-shaped locking slot located at a corner between a top face and the rear face of the body, and a right and left face;

preparing a number of contacts to have a first and second part, respectively, the second part being perpendicular to the first part, the first part having a contact portion and a first fitting portion;

mounting the contacts to the body by extending the first part into a corresponding contact passage to reach a position in which the first fitting portion has an interference fit with the body defining the corresponding contact passage, and extending the second part along the rear face of the body;

preparing a shielding shell to have an upper wall defining an inverted T-shaped locking tab protruding from a rear edge of the upper wall and two flaps extending downwards from two lateral sides of the upper wall, and a right and a left wall; and mounting the shielding shell to the body to electromagnetically shield the body by first bending the right and left walls to abut the right and left faces of the body and then bending the upper wall to abut the top face of the body and the inverted T-shaped locking tab to enter the inverted T-shaped locking slot to have an interference fit with the body wherein each of the two flaps is engaged with an upper edge of each of the right and left walls to prevent a rebound of the right and left walls to move away from the dielectric body.

14. The method in accordance claim 13, wherein the step of preparing a dielectric body comprises to form a vertical and horizontal ridge on each of the left and right faces of the body, the step of preparing a shielding shell comprises to form a horizontal and vertical projection on each of the left and right walls of the shielding shell, and the step of bending the right and left walls to abut the right and left faces of the body comprises to engage the horizontal projections with the horizontal ridges and the vertical projections with the vertical ridges.

15. The method in accordance with claim 13, wherein the step of preparing a dielectric body comprises to form a number of partitioning blocks along a bottom of the rear face of the body to define a number of locating grooves, and the step of mounting the contacts to the body comprises to extend each of the second parts of the contacts through a corresponding locating groove.

16. The method in accordance with claim 15, wherein the step of preparing contacts comprises to form a second fitting portion on each of the second parts of the contacts and the step of extending each of the second parts of the contacts through a corresponding locating groove comprises to cause the second fitting portion to have an interference fit with the body defining the corresponding locating groove.

* * * * *